US007025517B2

(12) United States Patent
Inaba

(10) Patent No.: US 7,025,517 B2
(45) Date of Patent: Apr. 11, 2006

(54) DETECTING THE PRINT POSITIONS OF A PRINTING MEDIUM AND KEEPING CONSTANT POSITIONS

(75) Inventor: Moriyoshi Inaba, Tokyo (JP)

(73) Assignee: Canon Finetech Inc., Mitsukaido (JP)

( * ) Notice: Subject to any disclaimer, the term of this patent is extended or adjusted under 35 U.S.C. 154(b) by 0 days.

(21) Appl. No.: 10/893,933

(22) Filed: Jul. 20, 2004

(65) Prior Publication Data

US 2005/0025554 A1 Feb. 3, 2005

(30) Foreign Application Priority Data

Jul. 28, 2003 (JP) ..... 2003-202538

(51) Int. Cl.
*B41J 11/26* (2006.01)

(52) U.S. Cl. ..... 400/611

(58) Field of Classification Search ..... 400/611, 400/582; 250/559.2, 548; 347/157, 23, 347/20, 19; 358/1.1, 1.9
See application file for complete search history.

(56) References Cited

U.S. PATENT DOCUMENTS 4,945,829 A * 8/1990 Ericsson ..... 101/129
5,041,850 A * 8/1991 Kahoyashi et al. ..... 347/157
5,293,047 A 3/1994 Matsuda ..... 250/589.2
5,507,583 A * 4/1996 Beaty et al. ..... 400/611
5,823,693 A * 10/1998 Henderson et al. ..... 400/611
5,843,252 A * 12/1998 Murphy ..... 156/64
6,019,531 A * 2/2000 Henderson et al. ..... 400/611
6,094,280 A 7/2000 Hayasaki et al. ..... 358/1.9
6,145,951 A 11/2000 Hayasaki et al. ..... 347/19
6,227,645 B1 5/2001 Takahashi et al. ..... 347/20
6,338,540 B1 1/2002 Hasegawa et al. ..... 347/23
6,384,921 B1 5/2002 Saijo et al. ..... 358/1.1

FOREIGN PATENT DOCUMENTS

JP 6191526 * 7/1994

* cited by examiner

*Primary Examiner*—Daniel J. Colilla
*Assistant Examiner*—Wasseem H. Hamdan
(74) *Attorney, Agent, or Firm*—Fitzpatrick, Cella, Harper & Scinto

(57) ABSTRACT

There is provided a printer capable of accurately detecting the print positions of a printing medium and keeping print positions where data are printed constant. A printer according to this invention can accurately detect the print positions of a printing medium and keep positions where data are printed constant by the following operation. More specifically, the printer sets a gap width (PG) for the printing medium and detects the position information of the conveyed printing medium by an optical sensor arranged on a convey path. The printer compares output values (Va, Vb) from the optical sensor with a threshold value (Vth) and obtains a detected gap width (AG) corresponding to the set gap width (PG). The printer changes the threshold value (Vth) such that the detected gap width (AG) coincides with the set gap width (PG).

4 Claims, 13 Drawing Sheets

FIG. 4A

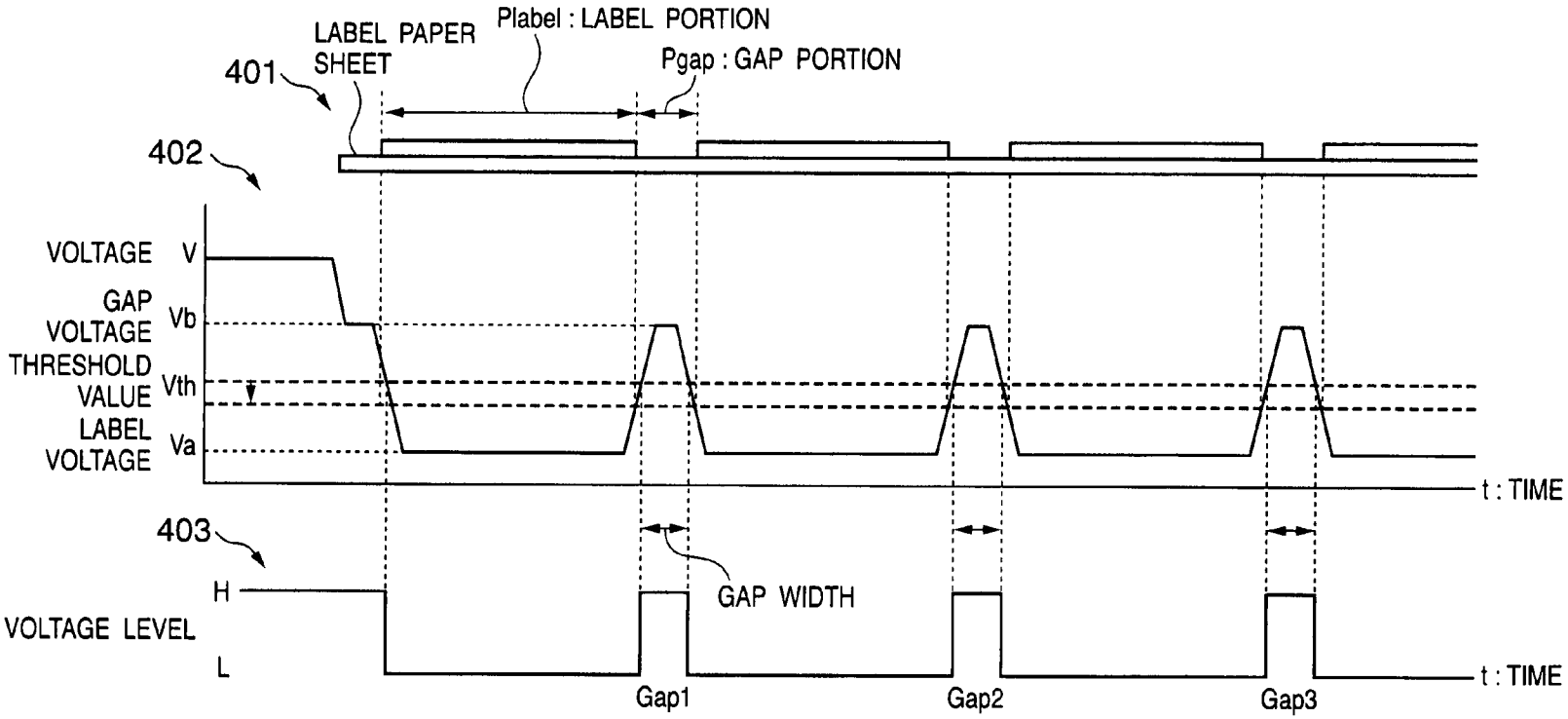

(3) RECOGNIZE HIGH LEVEL OF OUTPUT WAVEFORM 403 OF COMPARATOR AS GAP Pgap AND PERFORM MEASUREMENT (GAP1, GAP2,...)

(4) CALCULATE AVERAGE VALUE AG OF GAP WIDTH AND MEASURE DIFFERENCE (AG−PG) BETWEEN AVERAGE VALUE AG AND SET GAP WIDTH PG (5) OBTAIN CORRECTION AMOUNT (X) OF THRESHOLD VALUE FOR GAP WIDTH DIFFERENCE FROM CORRECTION AMOUNT ACQUISITION TABLE (6) CALCULATE CORRECTION AMOUNT Vth IN NEXT PRINTING OPERATION BY Vth=Vc+X AND STORE CORRECTION AMOUNT IN MEMORY

| GAP DIFFERENCE | THRESHOLD VALUE CORRECTION AMOUNT | GAP DIFFERENCE | THRESHOLD VALUE CORRECTION AMOUNT |
|---|---|---|---|
| −16 | −0x20 | 1 | 0x02 |
| −15 | −0x1E | 2 | 0x04 |
| −14 | −0x1C | 3 | 0x06 |
| −13 | −0x1A | 4 | 0x08 |
| −12 | −0x18 | 5 | 0x0A |
| −11 | −0x16 | 6 | 0x0C |
| −10 | −0x14 | 7 | 0x0E |
| −9 | −0x12 | 8 | 0x10 |
| −8 | −0x10 | 9 | 0x12 |
| −7 | −0x0E | 10 | 0x14 |
| −6 | −0x0C | 11 | 0x16 |
| −5 | −0x0A | 12 | 0x18 |
| −4 | −0x08 | 13 | 0x1A |
| −3 | −0x06 | 14 | 0x1C |
| −2 | −0x04 | 15 | 0x1E |
| −1 | −0x02 | 16 | 0x20 |
| 0 | 0x00 | | |

FIG. 5

501

| PAPER SHEET No.1 | | |
|---|---|---|
| PAPER TYPE | : LABEL PAPER SHEET | |
| VERTICAL PAPER SIZE | : 147 | |
| HORIZONTAL PAPER SIZE | : 102 | |
| GAP WIDTH | : 3 | |
| NEXT THRESHOLD VALUE Vth | : 0x60 | 96 |
| REFERENCE THRESHOLD VALUE Vc | : 0x52 | 82 |
| THRESHOLD VALUE CORRECTION VALUE | : 0x0E | 14 |

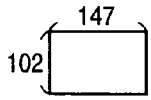

502

| PAPER SHEET No.2 | | |
|---|---|---|
| PAPER TYPE | : LABEL PAPER SHEET | |
| VERTICAL PAPER SIZE | : 76 | |
| HORIZONTAL PAPER SIZE | : 102 | |
| GAP WIDTH | : 3 | |
| NEXT THRESHOLD VALUE Vth | : 0x70 | 112 |
| REFERENCE THRESHOLD VALUE Vc | : 0x78 | 120 |
| THRESHOLD VALUE CORRECTION VALUE | : −0x08 | −8 |

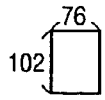

503

| PAPER SHEET No.3 | | |
|---|---|---|
| PAPER TYPE | : TAG PAPER SHEET | |
| VERTICAL PAPER SIZE | : 76 | |
| HORIZONTAL PAPER SIZE | : 102 | |
| MARK WIDTH | : 4 | |
| NEXT THRESHOLD VALUE Vth | : 0x73 | 115 |
| REFERENCE THRESHOLD VALUE Vc | : 0x6E | 110 |
| THRESHOLD VALUE CORRECTION VALUE | : 0x05 | 5 |

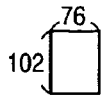

FIG. 8A

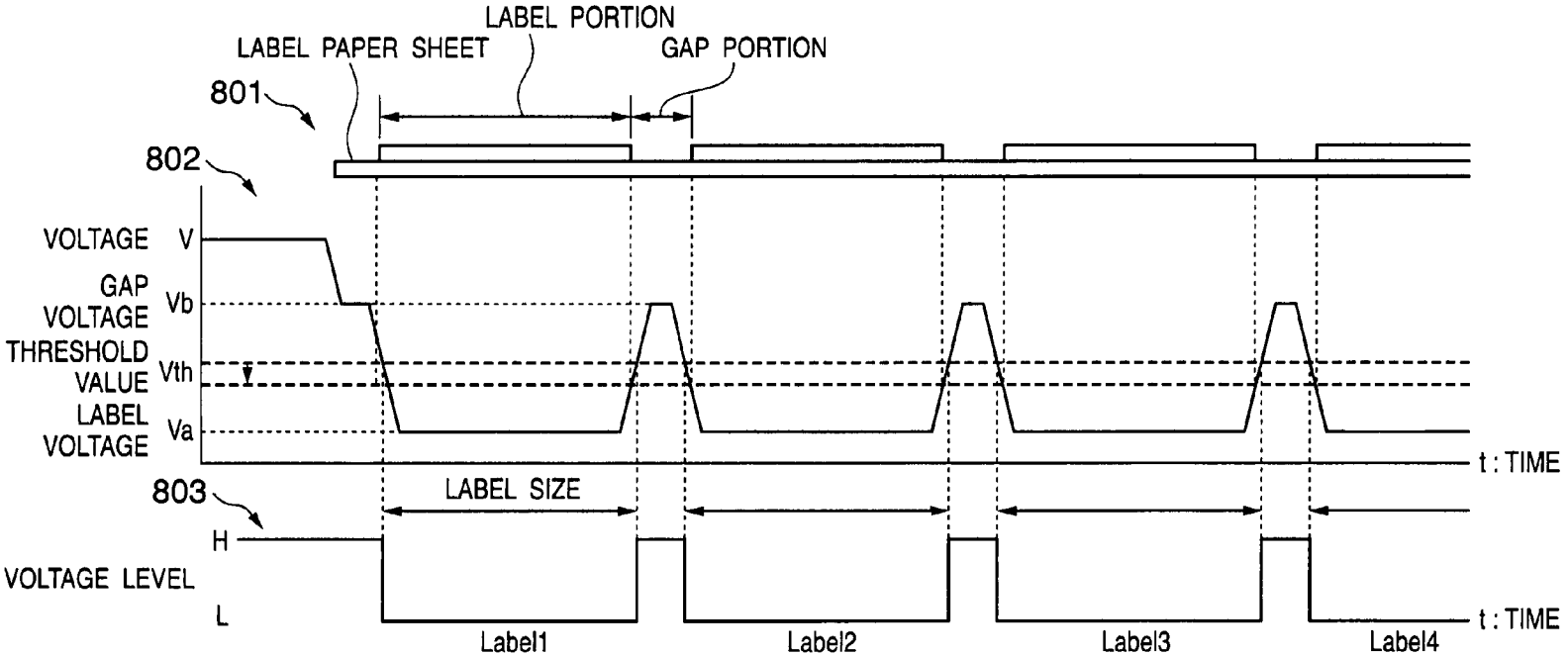

(1) READ Va AND Vb FROM OUTPUT VOLTAGE V
(2) CALCULATE REFERENCE THRESHOLD VALUE Vc BY Vc=(Va+Vb)/2
(3) RECOGNIZE LOW LEVEL OF COMPARATOR AS LABEL SIZE AND PERFORM MEASUREMENT (Label1, Label2,...)
(4) CALCULATE AVERAGE VALUE AL OF LABEL SIZE AND MEASURE DIFFERENCE (AL−PL) BETWEEN AVERAGE VALUE AND SET LABEL SIZE PL
(5) OBTAIN THRESHOLD VALUE CORRECTION AMOUNT (X) FOR LABEL SIZE DIFFERENCE FROM CORRECTION AMOUNT ACQUISITION TABLE
(6) CALCULATE CORRECTION AMOUNT Vth FOR NEXT PRINTING OPERATION BY Vth=Vth+X AND STORE CORRECTION AMOUNT IN MEMORY

DETECTING THE PRINT POSITIONS OF A PRINTING MEDIUM AND KEEPING CONSTANT POSITIONS

FIELD OF THE INVENTION

The present invention relates to a printer, printer control method, and control program and, more particularly, to detection of the print positions of a continuous printing medium which is used in a printer and whose print positions are defined at predetermined intervals.

BACKGROUND OF THE INVENTION

Conventionally, an optical sensor comprising a light-emitting device and light-receiving device which is arranged on a convey path detects positions of a paper sheet in a printer.

More specifically, in the case of a label paper sheet comprised of a layout sheet and labels, a transmission photointerrupter capable of measuring the amount of light passing through the label paper sheet is used as a sensor to detect label portions on which data are to be printed and gap portions between the label portions on which no data is to be printed. By comparing the output voltage from the sensor, which receives the transmitted light, with a reference voltage serving as a threshold value through a comparator, the label portions and gap portions can be determined.

On the other hand, in the case of a continuous tag paper sheet with marks at predetermined intervals, a reflection photointerrupter capable of measuring the amount of light reflected by the tag paper sheet is used as a sensor to detect inter-mark portions on which data are to be printed and mark portions on which no data is to be printed. By comparing the output voltage from the sensor, which receives the reflected light, with a reference voltage serving as a threshold value through the comparator, the inter-mark portions and mark portions can be determined.

However, in some cases, a conventional printer cannot accurately detect the position of the leading end of a paper sheet due to the characteristics of a sensor or the like. More specifically, when a printing medium such as a paper sheet used in the printer (e.g., a label paper sheet) is conveyed, and the leading end of a paper sheet portion (e.g., a label portion of the label paper sheet) starts crossing the sensor (e.g., a transmission photointerrupter), the sensor may not start detecting the position of the leading end of the paper sheet portion (e.g., the label portion) and may delay the detection. Alternatively, the sensor may start the detection when the leading end of the paper sheet portion has not started crossing the sensor.

In some cases, even when the leading end of a certain paper sheet such as a label paper sheet can accurately be detected, the leading end of another paper sheet cannot accurately be detected. Examples of the cases are one wherein a label paper sheet having a different label or layout sheet transmittance is used after the previous paper sheet, one wherein dust attracted to the paper sheet adversely affects the sensor, one wherein a change in light emission amount of the photointerrupter decreases the detection sensitivity of the sensor, and the like.

A printing start timing of a printhead is determined with respect to a detected paper sheet leading end. If the leading end of a paper sheet portion (e.g., a label portion of a label paper) cannot accurately be detected, as described above, the difference between a detected paper sheet leading end position obtained when the sensor detects the leading end of the paper sheet and an actual paper sheet leading end position appears as a shift in image print position. The shift in image print position prevents acquisition of a desired print result.

SUMMARY OF THE INVENTION

The present invention has been made to solve the above-mentioned conventional problems, and has as its object to provide a printer capable of accurately detecting the print positions of a printing medium and keeping constant positions where data are printed by the printer.

To attain the above-mentioned object, a printer according to an embodiment of the present invention has the following arrangement. More specifically, a printer which conveys in a convey direction a continuous printing medium having print positions specified at predetermined intervals and performs printing is characterized by comprising storage means for storing first information related to the print position of the printing medium, detection means arranged on a convey path for detecting position information on the conveyed printing medium and outputting a value, obtaining means for obtaining second information corresponding to the first information in accordance with the result of comparison between the output value from the detection means and a threshold, and threshold value change means for changing the threshold value such that the second information coincides with the first information.

For example, preferably, the detection means continuously irradiates the conveyed printing medium with light in a direction perpendicular to the convey direction of the printing medium and measures an amount of one of reflected light and transmitted light at positions of the printing medium, thereby detecting the position information of the printing medium.

For example, preferably, the printing medium is a label paper sheet comprised of a continuous layout sheet and labels affixed to the layout sheet at predetermined intervals, and the print position information includes one of a label size and a label gap.

For example, preferably, the printing medium is a continuous tag paper sheet with marks defining print positions at predetermined intervals, and the print position information includes one of a mark size and a mark gap.

For example, preferably, the threshold value change means changes the threshold value such that an average value of pieces of the detected print position information obtained by the print position information detection means during a plurality of number of times of detection coincides with the set print position information.

For example, preferably, when the print position information detection means obtains, during a print operation, the detected print position information corresponding to the set print position information, the threshold value change means changes the threshold value such that the detected print position information coincides with the set print position information when the print operation ends.

For example, preferably, the print position information detection means obtains, during a print operation, the detected print position information corresponding to the set print position information, the threshold value change means changes the threshold value such that the detected print position information coincides with the set print position information when a predetermined number of times of printing on the printing medium ends.

For example, preferably, the threshold value change means uses as a reference threshold value an average value of output values of label size portions and output values of gap portions between the label portions detected by the detection means in a print operation, compares an output value from the detection means with the reference threshold value in the print operation to detect one of the label size and the label gap, determines a correction amount for the reference threshold value such that one of the detected label size and the detected label gap coincides with one of a set label size and a set label gap, and changes the threshold value using the correction amount and the reference threshold value.

For example, preferably, the threshold value change means uses as a reference threshold value an average value of output values of mark portions and output values of gap portions between the mark portions detected by the detection means in a print operation, compares an output value from the detection means with the reference threshold value in the print operation to detect one of the mark size and the mark gap, determines a correction amount for the reference threshold value such that the one of the detected mark size and the detected mark gap coincides with one of a set mark size and a set mark gap, and changes the threshold value using the correction amount and the reference threshold value.

For example, preferably, the threshold value change means has a correction amount acquisition table with which a threshold value correction amount for correcting the reference threshold value can be calculated from a difference between the detected print position information and the set print position information and changes the threshold value using the correction amount acquisition table. The correction amount acquisition table is stored in memory 701 or EEPROM 702.

For example, preferably, the threshold value change means changes the threshold value in a convey operation of conveying the printing medium in a direction opposite to a direction of a print operation.

For example, preferably, if the detected print position information is different from the set print position information by not less than a predetermined value, the threshold value change means determines that an error has occurred and does not determine the threshold value.

For example, preferably, the threshold value change means holds initial values of different types of threshold values so as to support different types of printing media, and if the threshold value change means determines that printing medium print position information set by the setting means is different from printing medium print position information used in a previous print operation, the threshold value change means selects and uses an appropriate one of the held initial values of the threshold values.

To attain the above-mentioned object, a printer control method according to another embodiment of the present invention has the following arrangement. More specifically, there is provided a method of controlling a printer which comprises storage means for storing first information related to the print position of the printing medium, conveys a continuous printing medium having print positions defined at predetermined intervals in a convey direction and performs printing, comprising the steps of detecting position information on the conveyed printing medium and outputting a value, obtaining second information corresponding to the first information in accordance with the result of comparison between the output value from the detection means and a threshold, and changing the threshold value such that the second information coincides with the first information.

To attain the above-mentioned object, a control program according to still another embodiment of the present invention has the following arrangement. More specifically, there is provided a control program for controlling a printer which comprises storage means for storing first information related to the print position of the printing medium, conveys a continuous printing medium having print positions defined at predetermined intervals in a convey direction and performs printing, comprising the steps of detecting position information on the conveyed printing medium and outputting a value, obtaining second information corresponding to the first information in accordance with the result of comparison between the output value from the detection means and a threshold, and changing the threshold value such that the second information coincides with the first information.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 4A is a schematic chart for explaining an output waveform of the paper sheet detector according to the first embodiment;

FIG. 5 is a chart for explaining the storage contents of the memory of the printer according to the present invention;

FIG. 8A is a schematic chart for explaining an output waveform of a paper sheet detector according to the second embodiment;

DETAILED DESCRIPTION OF THE PREFERRED EMBODIMENTS

Preferred embodiments of the present invention will now be described in detail in accordance with the accompanying drawings.

The present invention is directed to a printer which performs printing while conveying in a convey direction a continuous printing medium whose print positions are specified at predetermined intervals. The present invention can be implemented as a printer comprising a setting unit which sets information on the print positions of a printing medium (PG), a detector which is placed on a convey path to detect the position information of a conveyed printing medium, a print position information detector which compares output values (Va and Vb) from the detector with a threshold value (Vth) and obtains the detected print position information (AG) which corresponds to the set print position information, and a threshold value change unit which changes the threshold value (Vth) such that the detected print position information (AG) coincides with the set print position information (PG).

This invention can be implemented in, e.g., the arrangements shown in FIGS. 1 to 10 so as to correspond to the following first to third embodiments.

(First Embodiment)

A preferred embodiment of the present invention will be described in detail with reference to the accompanying drawings.

In this specification, the term "printing" means not only formation of significant information such as a character, graphic, or the like but also formation of an image, pattern or the like (regardless of whether it is significant or insignificant and whether it is perceptible to the human eye) on a printing medium, or processing of a medium.

Examples of a "printing medium" are a label paper sheet comprised of a continuous layout sheet and labels affixed to the layout sheet at predetermined intervals or a continuous tag paper sheet with marks specifying print positions at predetermined intervals, and the like. A material for the printing medium is not limited to paper used in a general printing apparatus and may be one which can accept ink such as cloth, plastic film, or the like.

The term "ink" (also referred to as a "liquid") should be interpreted in a broad sense, similarly to the above-mentioned definition of the term "printing". The term "ink" means a liquid which is supplied to a printing medium and is used to form an image, pattern, or the like, process the printing medium, or process ink (e.g., coagulate or insolubilize a colorant in the ink to be supplied to the printing medium).

As the embodiment of the present invention, a printer which performs ink-jet printing will be illustrated below. A case will be described below wherein a label paper sheet comprised of a continuous layout sheet and labels affixed to the layout sheet at predetermined intervals is used as the printing medium. Note that in an explanation below, a label paper sheet will sometimes be referred to as a paper sheet.

Figure 1:
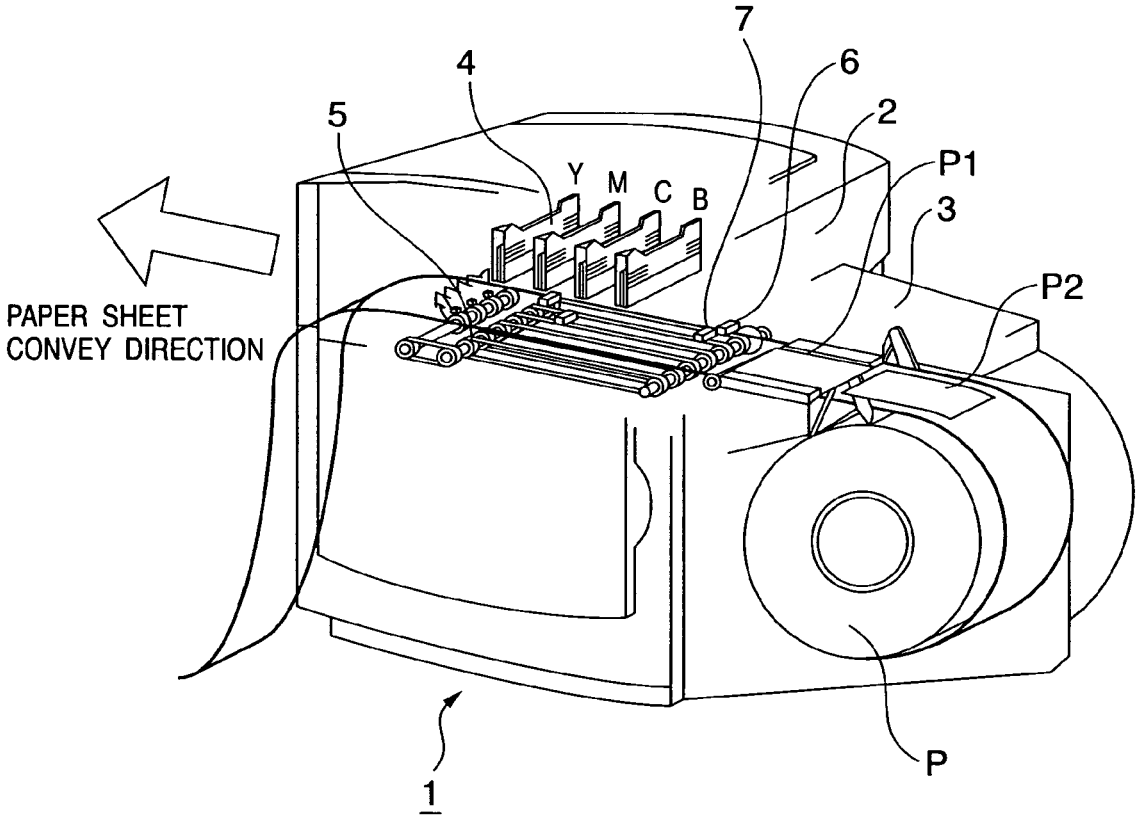
FIG. 1 is a view of the arrangement of a printer according to the present invention.

[Printer: FIG. 1]

FIG. 1 is a view showing the overall arrangement of a printer according to the present invention. In FIG. 1, reference numeral 1 denotes a printer main body 1. The printer 1 comprises an image printing unit 2 and a roll unit 3 serving as a paper supply unit which feeds a label paper sheet or tag paper sheet P to the image printing unit 2.

The image printing unit 2 comprises printheads 4 each of which has a plurality of ink-jet nozzles arranged in a direction perpendicular to a paper sheet convey direction (widthwise direction) and a convey unit 5 which conveys the paper sheet P serving as a printing medium fed from the roll unit 3 and makes the paper sheet P pass below the printheads 4. The printheads 4 comprise printheads 4 for discharging black, cyan, magenta, and yellow inks, respectively. A label paper sheet detector 6 which detects the paper sheet P (in the case of a label paper sheet) and a tag paper sheet detector 7 which detects the paper sheet P (in the case of a tag paper sheet) are arranged on the convey unit 5. The label paper sheet detector 6 and tag paper sheet detector 7 can detect paper sheets.

The convey unit 5 conveys a paper sheet portion P1. After the label paper sheet detector 6 or tag paper sheet detector 7 detects the leading end of the paper sheet portion P1, the paper sheet portion is conveyed by a defined distance. At this point, the printheads 4 are controlled to discharge inks in the order of black, cyan, magenta, and yellow, thereby printing an image on the surface of the paper sheet portion P1.

After the image is printed on the surface of the paper sheet portion P1, the paper sheet portion P1 is delivered from the printer main body 1, and the print operation ends. In this manner, the printer can print desired data at a predetermined position on a label.

In the next print operation, data is printed on an unprinted paper sheet portion P2 which is next to the previously printed paper sheet portion. The unprinted paper sheet portion P2 is conveyed to the upstream of the label paper sheet detector 6 and tag paper sheet detector 7 in a direction opposite to the print direction. Then, the print operation is preferably performed in accordance with the above-mentioned procedure.

By repeating a print operation and an operation of conveying an unprinted paper sheet portion to the upstream of the label paper sheet detector 6 and tag paper sheet detector 7 in the direction opposite to the print direction before the next print operation, the printer can continuously print desired data at a predetermined position on each label.

Figure 7:
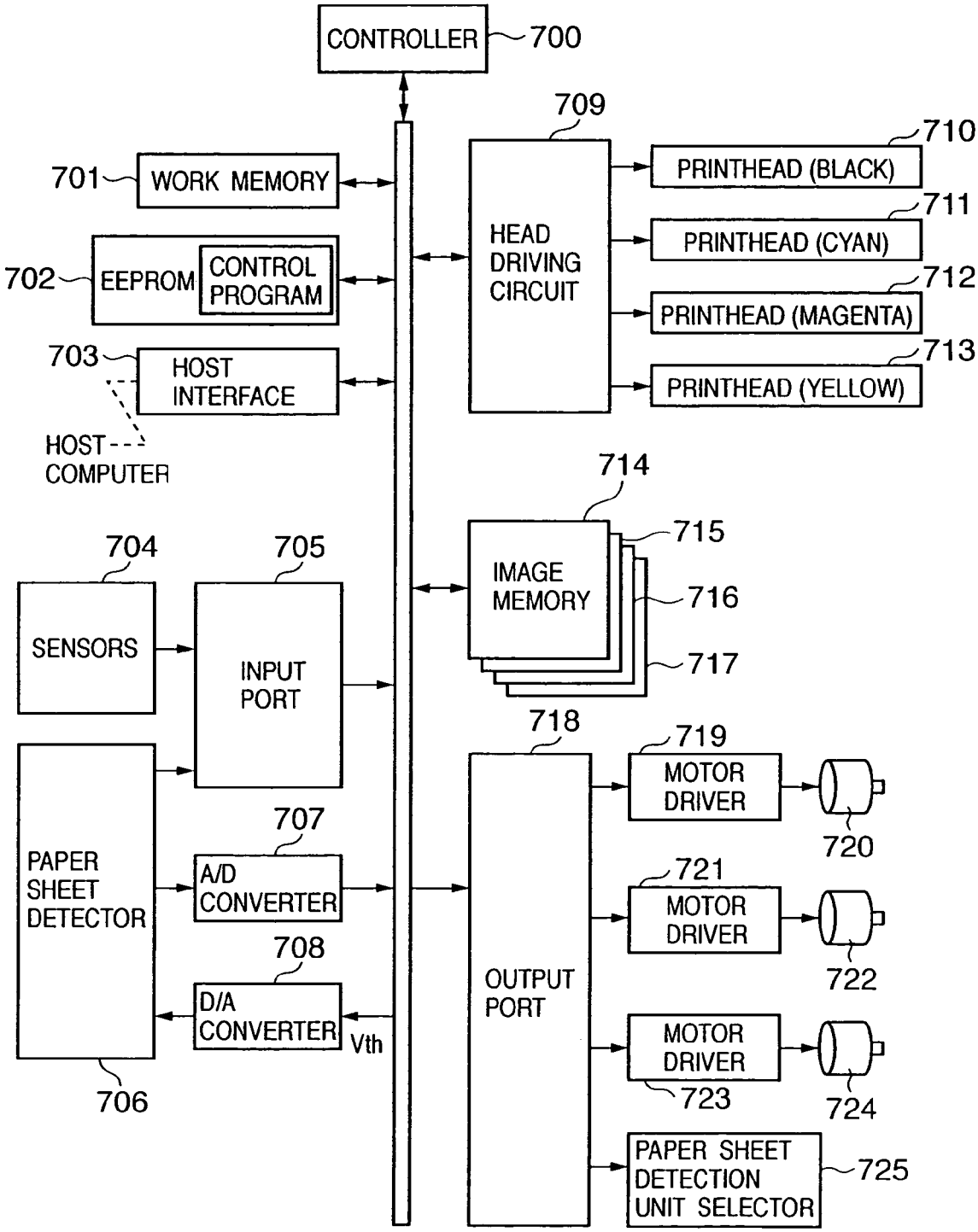
FIG. 7 is a block diagram of the electric circuit of the printer according to the present invention.

[Electric Circuit of Printer: FIG. 7]

FIG. 7 is a block diagram of the electric circuit of the printer.

A controller 700 is the CPU of a processor. The controller 700 loads, e.g., programs corresponding to the flowcharts shown in FIGS. 6 and 9, the correction amount acquisition table and other control programs which are stored in an EEPROM 702 into a work memory 701 and controls the entire printer.

When an image is transferred from a host computer to the printer through a host interface 703, separate print data are written in a yellow ink image memory 717, magenta ink image memory 716, cyan ink image memory 715, and black ink image memory 714 in order to reproduce a specified color. When the image rasterization for the four color inks ends, the controller 700 drives through an output port 718 and motor driver 719 a drive motor 720 for conveying a paper sheet in the convey unit 5. In synchronism with the conveyance of the paper sheet, the print data in the image memories 714 to 717 are transferred to printheads 710 to 713 through a head driving circuit 709. Each of the printheads 710 to 713 discharges an ink in response to a driving signal corresponding to the print data.

An output from and the output voltage of a paper sheet detector 706 are loaded by the controller 700 through an input port 705 and A/D converter 707, respectively. A threshold value voltage Vth for the paper sheet detector 706 is output from the controller 700 through a D/A converter 708. An output from the controller 700 is also supplied to a selector 725 through the output port 718. Storage information is stored in the EEPROM 702.

Outputs from sensors 704 are loaded through the input port. Motors 722 and 724 in the image printing unit 2 are driven through the output port 718 and motor drivers 721 and 723.

Figure 2:
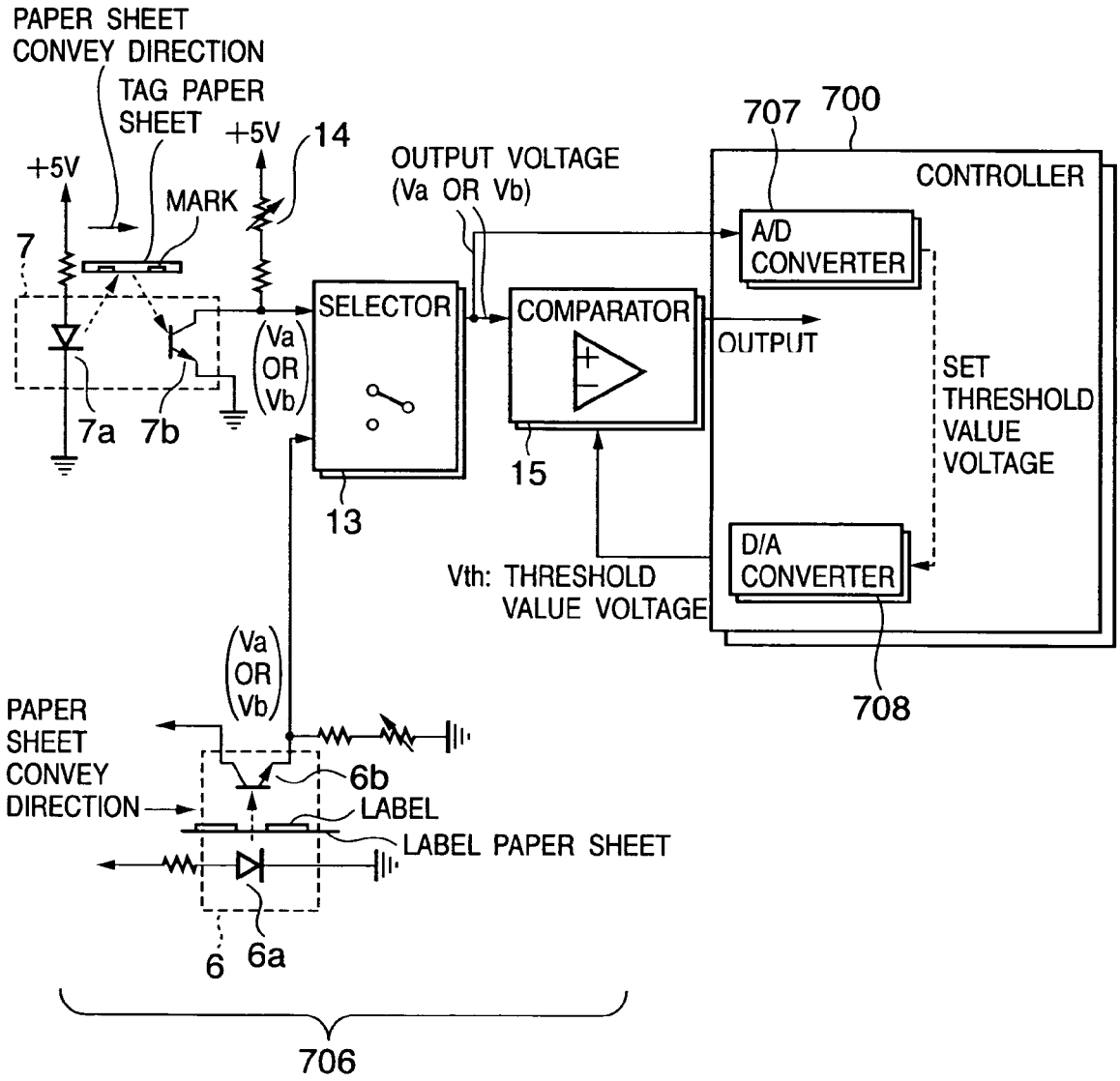
FIG. 2 is a block diagram of the circuit arrangement showing a paper sheet detector according to the present invention.

[Circuit Arrangement of Paper Sheet Detector: FIG. 2]

FIG. 2 is a block diagram of the circuit arrangement showing the paper sheet detector 706.

The tag paper sheet detector 7 is a reflection sensor which is arranged below a paper sheet path and comprises a light-emitting diode 7*a* and phototransistor 7*b*.

A volume resistor 14 is connected to the collector side of the phototransistor 7*b* to determine the gain resistance. The collector side of the phototransistor 7*b* outputs a voltage value Va according to the presence/absence of the paper sheet (tag paper sheet) P and a voltage value Vb at marked portions of the paper sheet. The output voltage values Va and Vb and the threshold value voltage Vth pass through a comparator 15. This enables the controller 700 to detect the tag paper sheet and marks. The voltage values Va and Vb pass through the A/D converter 707 and are loaded by the controller 700. The threshold value voltage Vth is set by the controller 700 through the D/A converter 708.

The label paper sheet detector 6 is a transmission sensor comprising a light-emitting diode 6*a* and phototransistor 6*b*. The label paper sheet detector 6 can detect labels and the gaps between them, similarly to the tag paper sheet detector 7. A selector 13 can select the label paper sheet detector 6 or tag paper sheet detector 7 and performs switching between the label paper sheet detector 6 and the tag paper sheet detector 7 depending on the type of a paper sheet used serving as a printing medium.

[Output Waveform and Reference Threshold Value Determination Method of Paper Sheet Detector: FIGS. 3A to 4B]

Figure 3A:
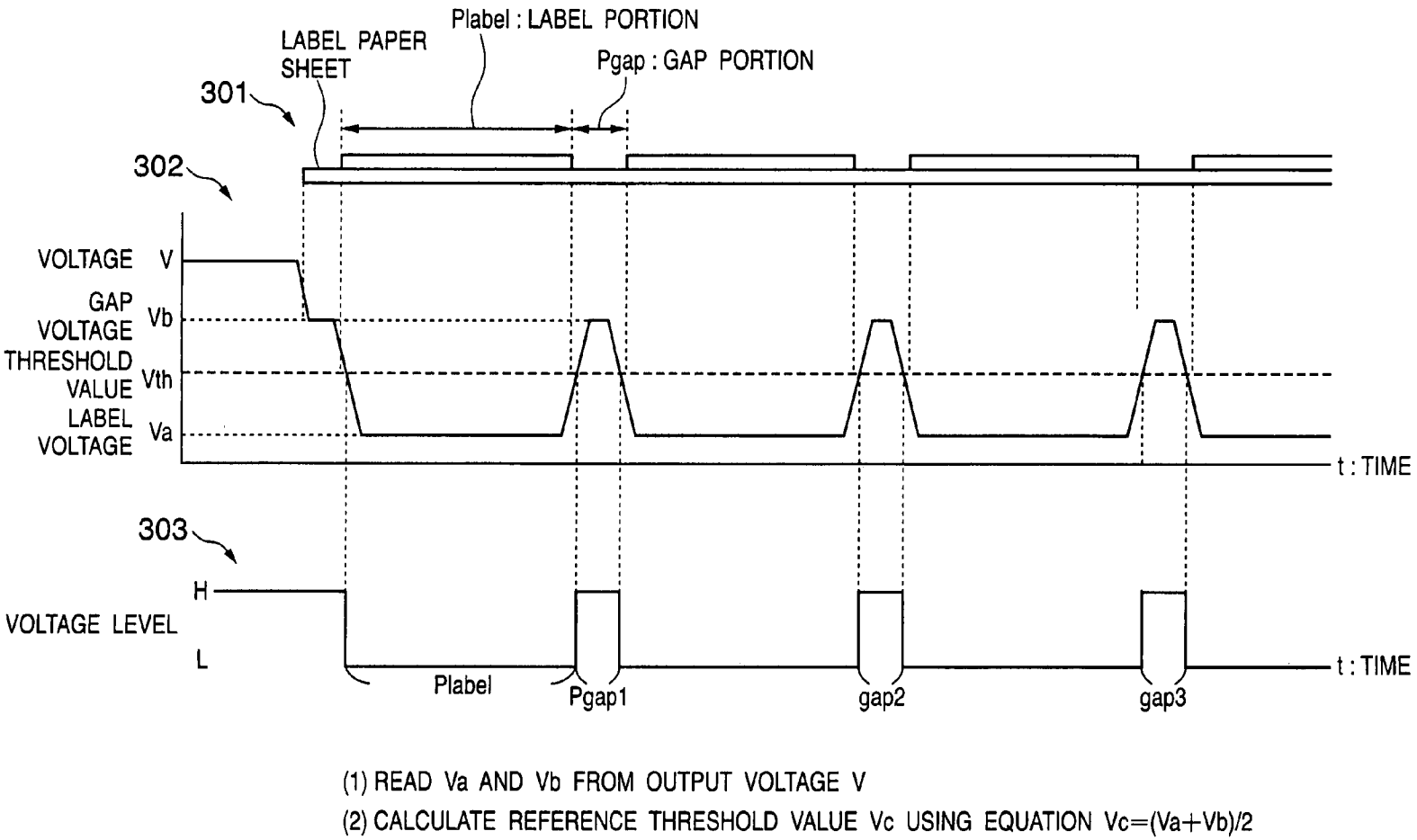
FIG. 3A is a schematic chart for explaining an output waveform of a paper sheet detector according to the first embodiment.
Figure 3B:
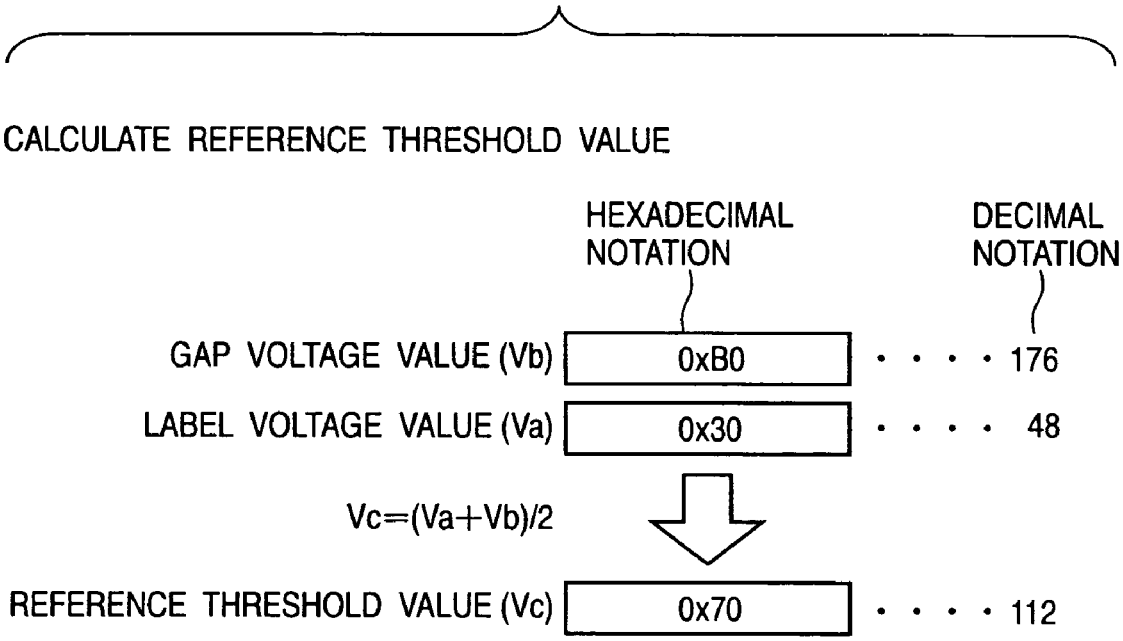
FIG. 3B is a schematic diagram for explaining a reference threshold value determination method according to the first embodiment.
Figure 4B:
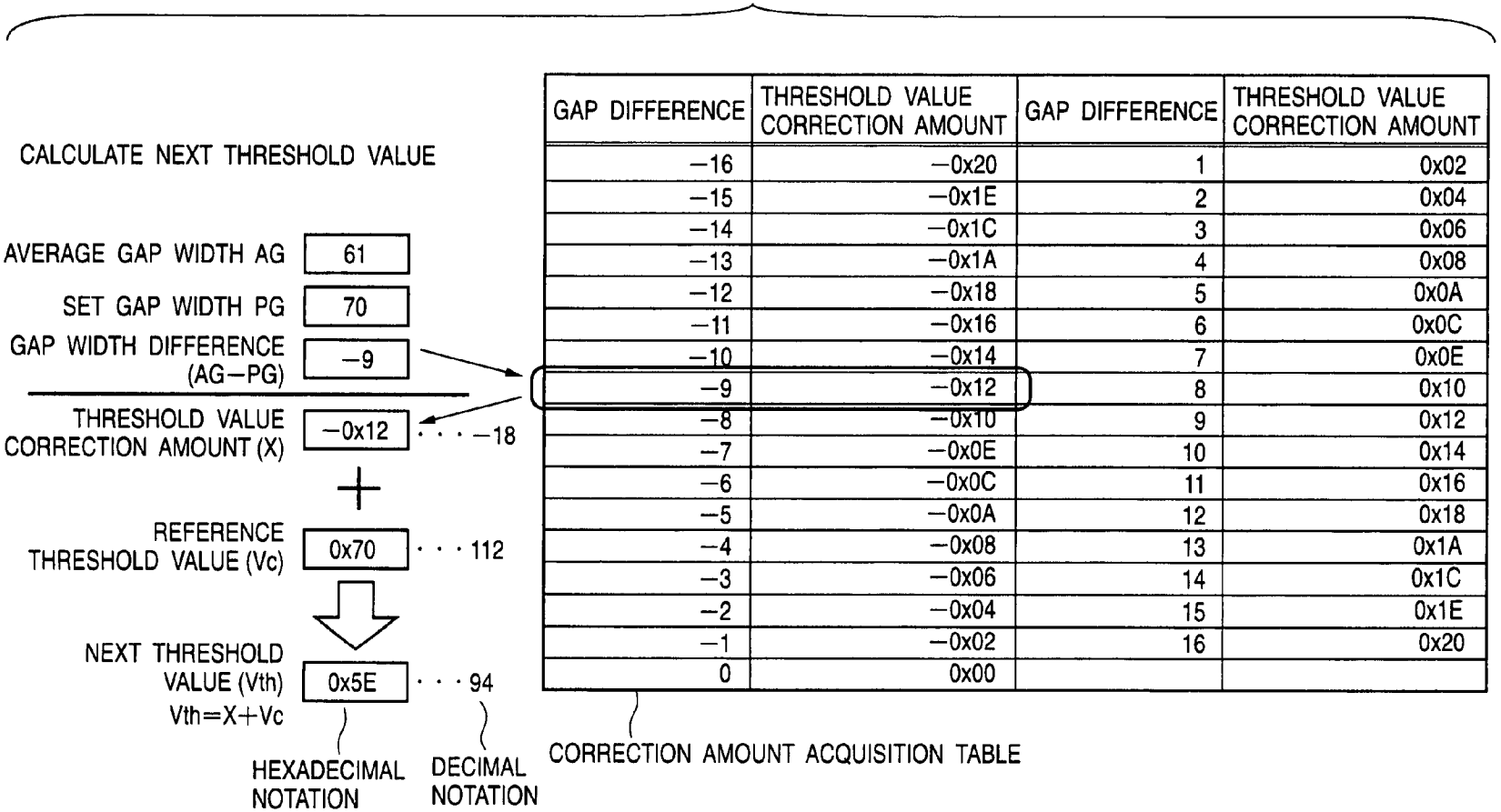
FIG. 4B is a schematic diagram for explaining a threshold value change method according to the first embodiment.

FIGS. 3A and 3B are schematic charts for explaining an output waveform and the reference threshold value determination method of the paper sheet detector 706. FIGS. 4A and 4B are schematic charts for explaining an output waveform and the threshold value determination method of the paper sheet detector 706. A method of determining (changing) the threshold value Vth will be described with reference to FIGS. 3A, 3B, 4A, and 4B.

When a print operation starts, and the label paper sheet P indicated by reference numeral 301 in FIG. 3A passes on the paper sheet detector 706, an output waveform indicated by reference numeral 302 in FIG. 3A is output. Reference numeral 302 in FIG. 3A denotes a waveform which plots time t along the abscissa and a voltage V along the ordinate. As the label paper sheet passes along the paper sheet passing path, the waveform is plotted on the basis of the voltage value Va corresponding to label portions $P_{label}$ and the voltage value Vb corresponding to gap portions $P_{gap}$ between the label portions.

The output voltage in FIG. 3A is compared with the threshold value Vth, thereby obtaining a waveform indicated by reference numeral 303 in FIG. 3A. The controller 700 recognizes portions at high level in FIG. 3A as the gap portions $P_{gap}$ and portions at low level as the label portions $P_{label}$. The controller 700 uses the waveform 303 to perform control such as detection of the position of the paper sheet P (e.g., detect the positions of the label portions and gap portions), detection of a timing of starting printing on each label portion, JAM detection for the paper sheet P, and the like.

A method of determining a reference threshold value Vc for determining the threshold value Vth from the output signal in FIG. 3A will be described with reference to FIG. 3B.

The controller 700 reads the output value indicated by reference numeral 302 in FIG. 3A through the A/D converter 707. The controller 700 measures the voltage value Vb of the label portions $P_{label}$ and the voltage value Va of the gap portions $P_{gap}$. The reference threshold value Vc can be determined by the following equation:

$$Vc=(Va+Vb)/2$$

FIG. 3B shows an example of a method of calculating the reference threshold value Vc in hexadecimal notation (measurement values to be actually obtained) and decimal notation.

More specifically, in hexadecimal notation, since the gap portion voltage value Vb is represented as 0xB0, and the label voltage value Va is represented as 0x30, the reference threshold value Vc is represented as 0x70 (in decimal notation, since the gap portion voltage value Vb is represented as 176, and the label voltage value Va is represented as 48, the reference threshold value Vc is represented as 112).

An example of a method of determining a correction amount for the reference threshold value Vc to determine the threshold value Vth will be described with reference to FIGS. 4A and 4B.

A gap width Gap during a print operation (corresponding to each gap portion $P_{gap}$) is measured on the basis of a waveform indicated by reference numeral 403 in FIG. 4A to obtain a gap width AG during the print operation (61 in the example of FIG. 4A).

As shown in FIG. 4B, a gap width difference AG−PG (−9 in the example of FIG. 4B) is measured on the basis of the gap width Gap (61 in the example) measured in FIG. 4A and a set gap width PG (70 in the example of FIG. 4B) which is set as a paper sheet parameter by the host computer (not shown).

With the gap width difference AG−PG (−9 in the example), a correction amount acquisition table stored in the memory 701 or EEPROM 702 shown in FIG. 4B is looked up to obtain a threshold value correction amount X (−0x12 in the example of FIG. 4B). The sum of the correction amount and the reference threshold value Vc (i.e., Vth=X+Vc) is used as the threshold value Vth in the next print operation.

In the example of FIG. 4B, Vth=−0x12+0x70=0x5E (in hexadecimal notation) (in decimal notation, Vth=−18+112=94).

[Storage Contents of Printer Memory: FIG. 5]

FIG. 5 shows an example of the storage contents of the memory 701 or EEPROM 702 of the printer 1. Reference numeral 501 denotes the memory storage contents for paper sheet No. 1 (label); 502, the memory storage contents for paper sheet No. 2 (label); and 503, the memory storage contents for paper sheet No. 3 (tag).

The threshold value Vth, which is obtained by changing the reference threshold value Vc with the threshold value correction value X using the method described with reference to FIGS. 3A to 4B, is stored in the memory 701 or EEPROM 702 of the printer 1, together with a paper type (label paper sheet or tag paper sheet), a paper size, the reference threshold value Vc, the threshold value correction amount, and the like, as indicated by reference numerals 501 to 503.

When the printer 1 is shut down, the threshold value voltage Vth is stored in an EEPROM 702 of the printer 1, together with the paper type, paper size, reference threshold value Vc, and threshold value correction amount. When the power is turned on, these parameters are loaded from the EEPROM 702 into the memory 701 and are used.

If the paper size and paper type set by the host computer (not shown) and stored in the memory 701 or EEPROM 702 are different from those in the print operation described with reference to FIGS. 3A to 4B, the printer determines that paper change has been performed and changes the threshold value Vth. At this time, if a threshold value is already set for the paper size and paper type to be used in the current print operation in the memory storage contents (stored in the memory 701 or EEPROM 702), the set value is used as the threshold value Vth. On the other hand, if no threshold value is set for the paper size and paper type to be used in the current print operation in the memory storage contents, a default value is used as the threshold value Vth.

Operation of the embodiment with the above-mentioned arrangement will be described with reference to a flowchart.

Figure 6:
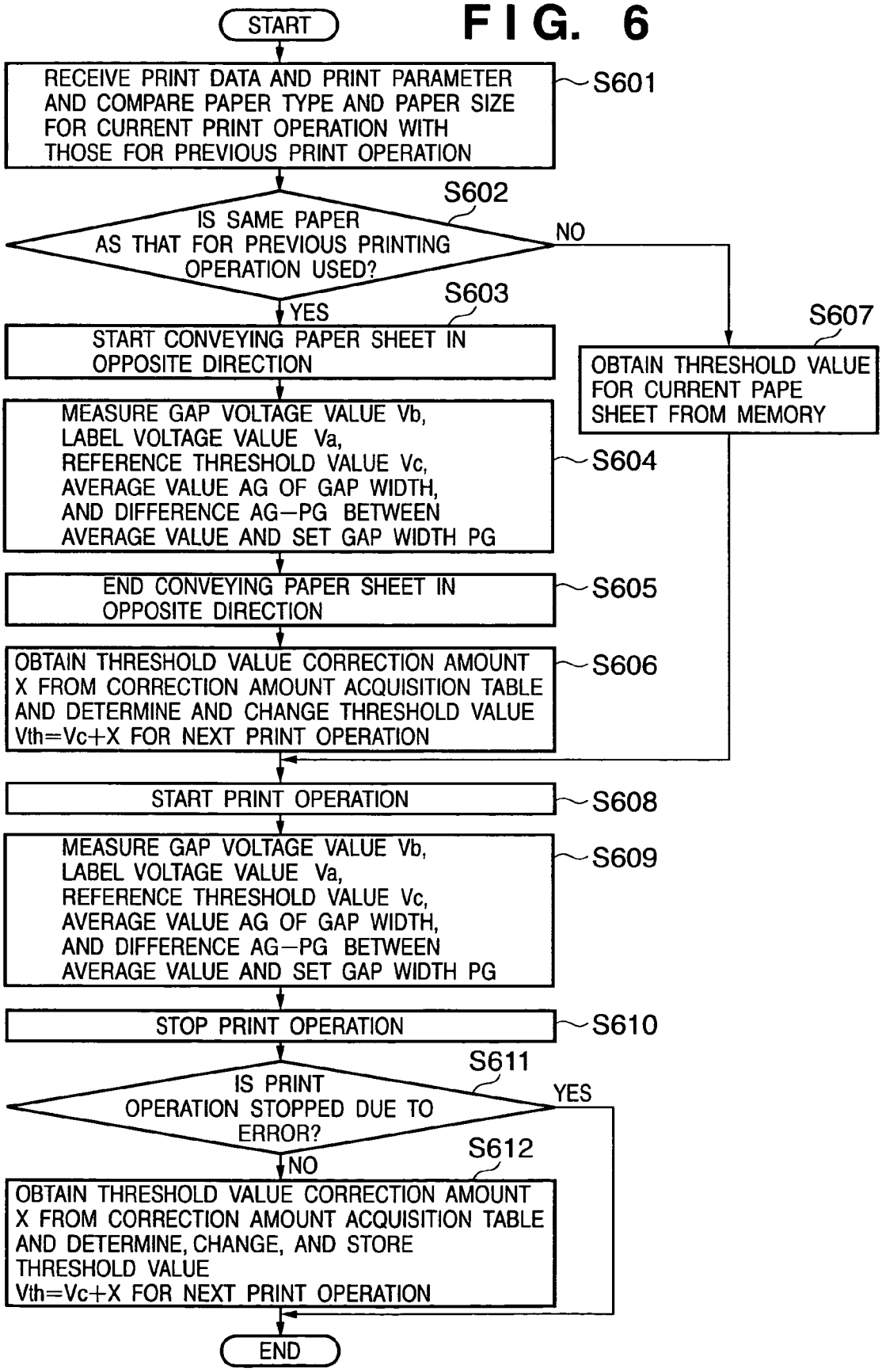
FIG. 6 is a flowchart for determining the threshold value of the printer according to the present invention.

[Threshold Value Determination Process: FIG. 6]

FIG. 6 is a flowchart of the above-mentioned threshold value determination process. The process is executed while the controller (CPU) 700 of the printer controls the remaining units of the printer in accordance with the control program stored in the EEPROM 702.

A threshold value determination (change) timing will be described below with reference to FIG. 6.

The threshold value determination (change) method described with reference to FIGS. 3A to 5 is performed in the following manner. More specifically, measurement of the gap width shown in FIG. 4A and the like is performed every print operation as shown in steps S608 (start of a print operation), S609 (measurement of the gap voltage value Vb, label voltage value Va, and gap width), and S610 (completion of the print operation or abnormal end). In step S612 after the print operation, the threshold value Vth to be used in the next print operation is automatically determined or changed (corrected) and is stored.

The printer conveys the paper sheet P in the opposite direction before a print operation, as described above. At this time as well, gap width measurement is performed, as shown in steps S603 to S606, and the threshold value Vth is determined or corrected. As shown in steps S601 and S602, the printer receives print data and print parameters from the host computer (not shown). The paper type and paper size are obtained from the print parameters and compared with those in the previous print operation. If it is determined that paper change has been performed, the threshold value Vth is determined by the above-mentioned method, as shown in step S607, and the paper sheet is not conveyed in the opposite direction.

The output indicated by reference numeral 303 in FIG. 3A is measured during the print operation. If a measured gap width (or the width of label portions) is different from a set gap width (or the width of the label portions) by a predetermined value or more, a signal indicating a paper jam is issued. When this signal is detected, control is so performed as to stop the print operation. If such an error is detected, and the print operation is stopped, the threshold value Vth is not updated by the above-mentioned threshold value determination (change) method, as shown in step S611, and control is so performed as to execute the next print operation using the threshold value for the previous print operation as the threshold value Vth.

As described above, in the printer according to this embodiment of the present invention, preferably, the detector continuously irradiates a conveyed printing medium with light in a direction perpendicular to the convey direction of the printing medium and measures the amount of reflected light or transmitted light at positions of the printing medium, thereby detecting the position information of the printing medium.

Alternatively, preferably, the printing medium is a label paper sheet comprised of a continuous layout sheet and labels affixed to the layout sheet at predetermined intervals, and print position information includes the size of the labels or the gap between the labels.

Alternatively, preferably, the printing medium is a continuous tag paper sheet with marks defining print positions at predetermined intervals, and print position information includes the size of the marks or the gap between the marks.

Alternatively, preferably, if the print position information detector obtains detected print position information (AG) corresponding to set print position information (PG) during a print operation, the threshold value change unit changes a threshold value (Vth) such that the detected print position information (AG) coincides with the set print position information (PG) when the print operation ends.

Alternatively, preferably, if the print position information detector obtains the detected print position information (AG) corresponding to the set print position information (PG) during a print operation, the threshold value change unit changes the threshold value (Vth) such that the detected print position information (AG) coincides with the set print position information (PG) when a predetermined number of times of printing on the printing medium ends.

Alternatively, preferably, the threshold value change unit sets as a reference threshold value the average value of output values of label size portions and output values of gap portions between the label portions detected by the detector in printing. The threshold value change unit compares an output value from the detector with the reference threshold value and detects a label size or label gap in printing. The threshold value change unit determines a correction amount for the reference threshold value such that the detected label size or label gap coincides with a set label size or label gap. The threshold value change unit changes the threshold value using the correction amount and reference threshold value.

Alternatively, the threshold value change unit preferably performs the following operation. More specifically, the threshold value change unit sets as the reference threshold value the average value of output values of mark size portions and output values of gap portions between the mark portions detected by the detector in printing. The threshold value change unit compares an output value from the detector with the reference threshold value and detects a mark size or mark gap in printing. The threshold value change unit determines a correction amount for the reference threshold value such that the detected mark size or mark gap coincides with a set mark size or mark gap. The threshold value change unit changes the threshold value using the correction amount and reference threshold value.

Alternatively, preferably, the threshold value change unit has a correction amount acquisition table with which a threshold value correction amount for correcting the reference threshold value can be calculated from the difference between the detected print position information and the set print position information. The threshold value change unit preferably changes the threshold value using the correction amount acquisition table.

Alternatively, the threshold value change unit preferably changes the threshold value in a convey operation which conveys the printing medium in a direction opposite to the print operation.

Alternatively, preferably, if the detected print position information is different from the set print position information by a predetermined value or more, the threshold value change unit determines that an error has occurred, and does not determine the threshold value.

Alternatively, the threshold value change unit preferably holds the initial values of different types of threshold values so as to support different types of printing media. Preferably, if the threshold value change unit determines that printing medium print position information set by the setting unit is different from that used in the previous print operation, it selects and uses an appropriate one of the held initial values of the threshold values.

As has been described above, in the printer according to the first embodiment, a threshold value voltage is changed such that a measured gap width of a label paper sheet coincides with a set gap width. This makes it possible to perform accurate paper sheet position detection and keep positions on labels where print information is printed constant, without being influenced by, e.g., the paper type, paper dust, an optical-sensor (the light emission amount of a photointerrupter), and the like.

(Second Embodiment)

The second embodiment of the present invention will be described with reference to FIG. 8A to 9.

Note that out of the second embodiment, only portions different from the first embodiment will be described.

Figure 8B:
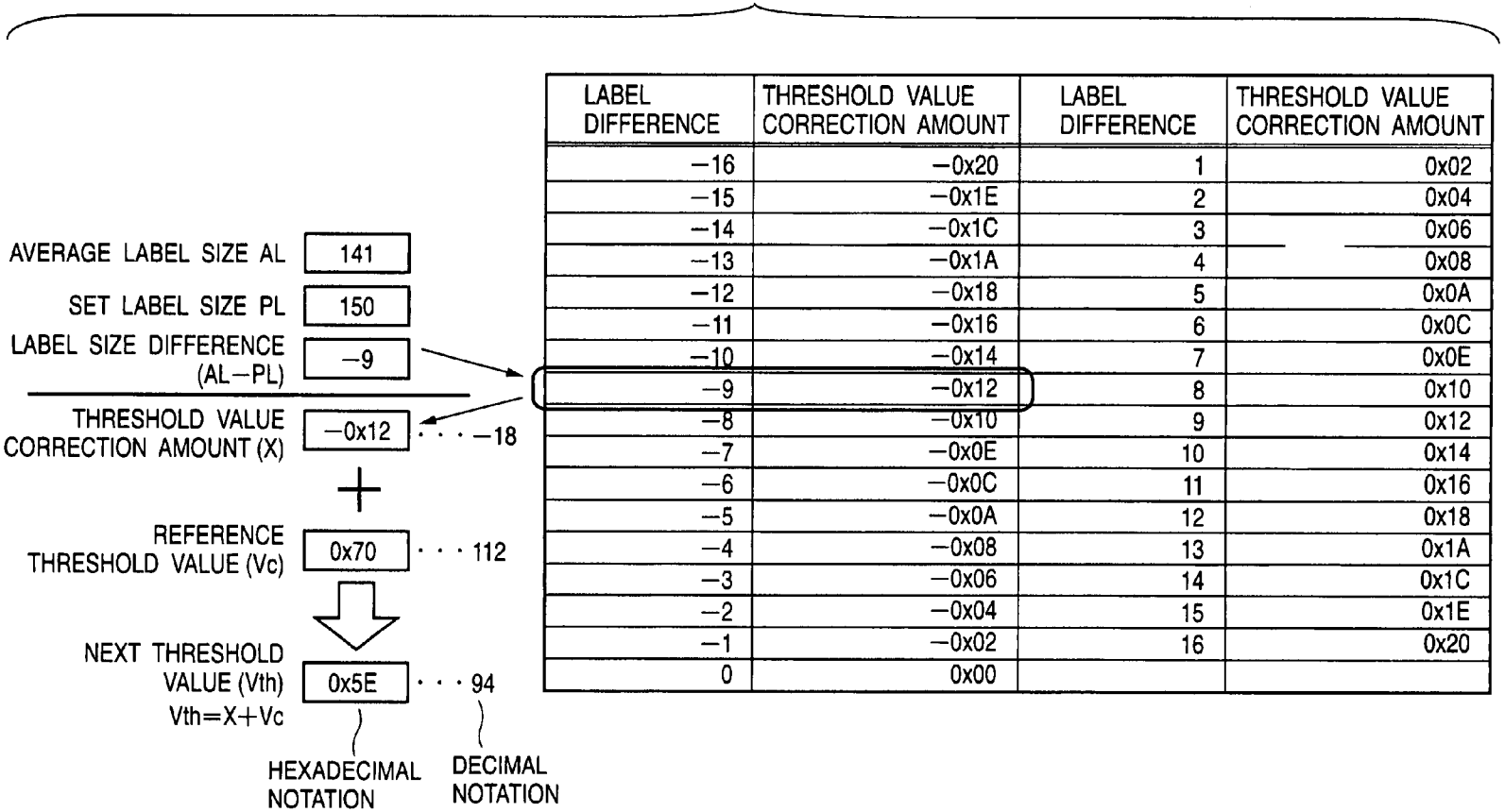
FIG. 8B is a schematic diagram for explaining a threshold value determination method according to the second embodiment.

[Output Waveform and Threshold Value Determination (Change) Method of Paper Sheet Detector: FIGS. 8A and 8B]

FIGS. 8A and 8B are schematic charts for explaining an output waveform and the threshold value determination (change) method of a paper sheet detector. The threshold value correction amount for the second embodiment is determined by a label size (the width of a label portion). In a print operation, threshold value determination (change) is performed every predetermined number of pages, i.e., when printing of a predetermined number of labels ends. Note that the threshold value determination (change) may be performed when printing of one label ends.

Label sizes (the widths of label portions) are measured from a waveform indicated by reference numeral 803 in FIG. 8A during a plurality of number of times of print operations. An average label size AL is calculated using the measured label sizes. A difference AL−PL between the average label size and a set label size PL set as a paper sheet parameter by a host computer is obtained.

With the label size difference AL−PL, a correction amount acquisition table in FIG. 8B is looked up, thereby obtaining the threshold value correction amount. The sum of the correction amount and a reference threshold value Vc is determined (changed) as a threshold value Vth in the next print operation.

Operation of the embodiment with the above-mentioned arrangement will be described with reference to a flowchart.

[Threshold Value Determination Process: FIG. 9]

Figure 9:
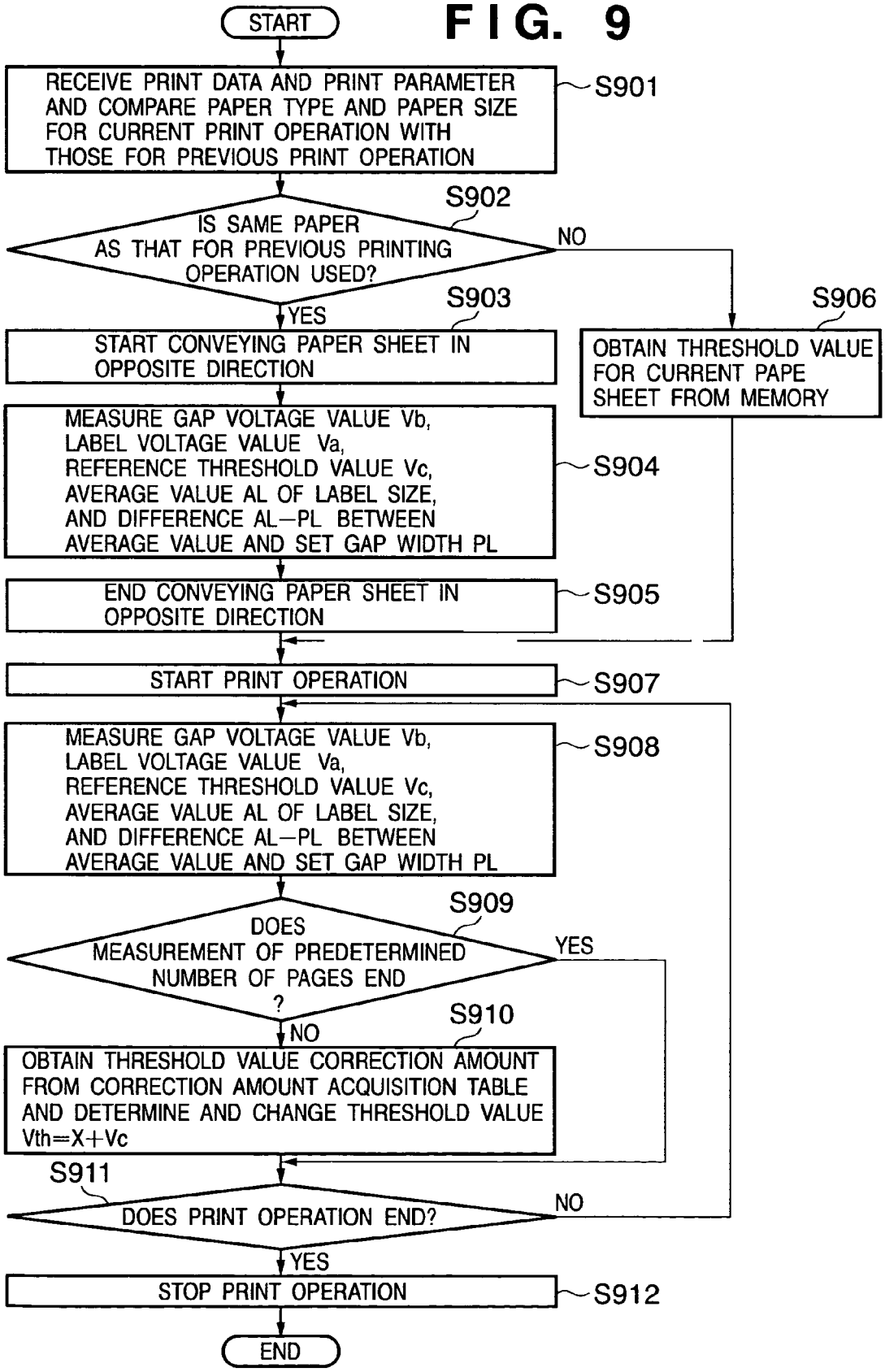
FIG. 9 is a flowchart for determining the threshold value of a printer according to the second embodiment.

FIG. 9 is a flowchart of the above-mentioned threshold value determination process. The process is executed while the controller (CPU) 700 of the printer controls the remaining units of the printer in accordance with the control program stored in the EEPROM 702. Note that in the explanation of FIG. 9 (second embodiment), only portion different from FIG. 6 (the first embodiment) will be described. As shown in steps S909 and S910, a method of determining the threshold value according to the second embodiment is executed every detection of a predetermined number of pages (e.g., a predetermined number of labels) of a paper sheet (e.g., a label paper sheet). The threshold value is automatically determined and corrected.

As described above, a printer according to this embodiment, preferably, a threshold value change unit changes the threshold value such that the average value of pieces of detected print position information obtained by a print position information detector during a plurality of number of times of detection coincides with set print position information.

As has been described above, in the printer according to the second embodiment, a threshold value voltage is changed such that a measured gap width of a label paper sheet coincides with a set label width. In a print operation, threshold value determination (change) can be performed every predetermined number of pages, i.e., when printing of a predetermined number of labels ends. This makes it possible to accurately detect the position of a paper sheet (e.g., the position of a label) and keep positions on labels where print information is printed constant, without being influenced by, e.g., the paper type, paper dust, an optical sensor, and the like.

(Third Embodiment)

The third embodiment of the present invention will be described with reference to FIG. 10.

Note that out of the third embodiment, only portions different from the first embodiment will be described.

Figure 10:
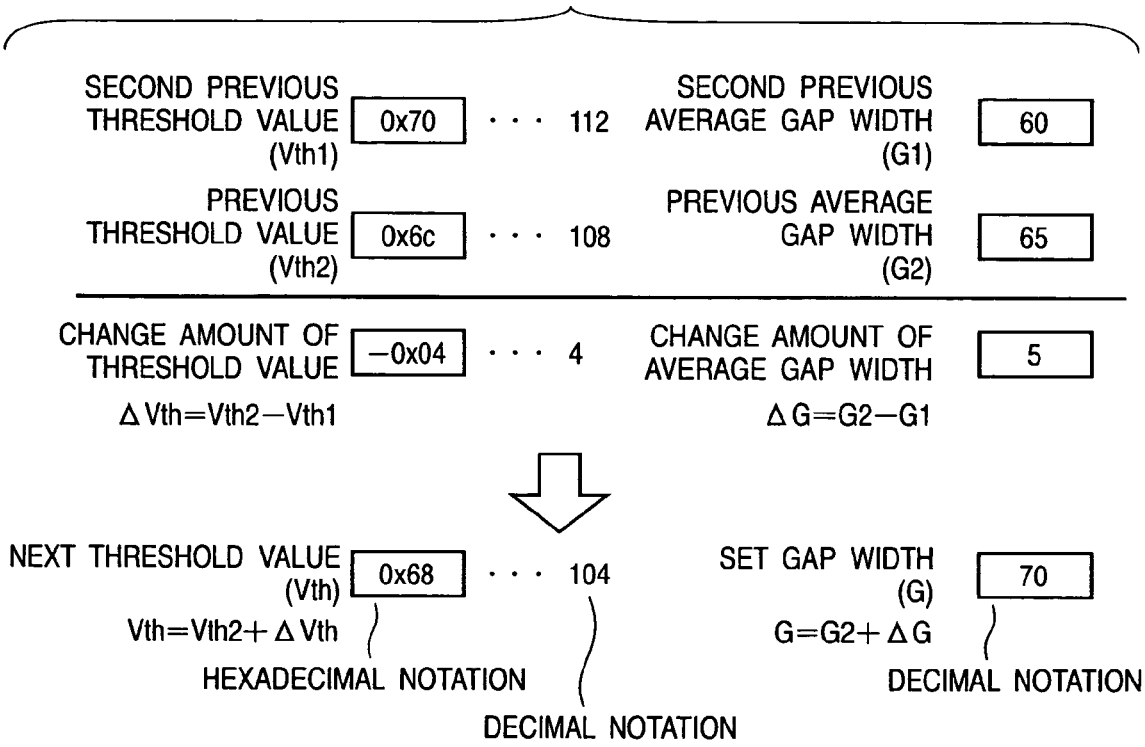
FIG. 10 is a schematic diagram for explaining a threshold value determination method according to the third embodiment.

FIG. 10 is a schematic chart for explaining a threshold value determination method. A threshold value for the third embodiment is determined by the change amount of a threshold value Vth obtained in a print operation and the change amount of a measured gap width.

In this case, a defined threshold value is used as a threshold value Vth1 in the second previous print operation, and a specified threshold value is used as a threshold value Vth2 in the previous print operation. In this state, a print operation is performed while measuring gap widths G1 and G2.

Then, as shown in FIG. 10, a threshold value change amount ΔVth (=Vth2−Vth1) and an average gap width change amount ΔG (=G2−G1) are calculated from the threshold values Vth1 and Vth2. The threshold value Vth (=Vth2−Vth1) in the next print operation is calculated from the threshold value change amount ΔVth and the threshold value Vth2 in the previous print operation. A set gap width G in the next print operation is calculated from the average gap width change amount ΔG and the average gap width G2 in the previous print operation. The threshold value Vth and set gap width G thus obtained are used in the next print operation. The third embodiment is implemented by this calculation method.

[Other Embodiment]

Note that the present invention can be implemented as a system, apparatus, method, program, storage medium, or the like. More specifically, the present invention may be applied to either a system constituted by a plurality of devices (e.g., a host computer, interface device, reader, printer, and the like), or an apparatus consisting of a single equipment (e.g., a copying machine, facsimile apparatus, or the like).

The objects of the present invention are also achieved by supplying a storage medium, which records a program code of a software program that can implement the functions of the above-mentioned embodiments to the system or apparatus, and reading out and executing the program code stored in the storage medium by a computer (or a CPU or MPU) of the system or apparatus.

In this case, the program code itself read out from the storage medium implements the functions of the above-mentioned embodiments, and the storage medium which stores the program code or the program itself constitutes the present invention.

As the storage medium for supplying the program code, for example, a floppy (registered trademark) disk, hard disk, optical disk, magneto-optical disk, CD-ROM, CD-R, magnetic tape, nonvolatile memory card, ROM, and the like may be used.

The functions of the above-mentioned embodiments may be implemented not only by executing the readout program code by the computer but also by some or all of actual processing operations executed by an OS (operating system) running on the computer on the basis of an instruction of the program code.

Furthermore, the functions of the above-mentioned embodiments may be implemented by some or all of actual processing operations executed by a CPU or the like arranged in a function extension board or a function extension unit, which is inserted in or connected to the computer, after the program code read out from the storage medium is written in a memory of the extension board or unit.

If the present invention is applied to the above-mentioned storage medium, the storage medium stores a program code corresponding to the above-mentioned flowcharts (shown in FIGS. 6 and 9).

As has been described above, in a printer according to this embodiment, a threshold value voltage is changed such that a measured label width or gap width of a label paper sheet coincides with a set label width or gap width. This makes it possible to accurately detect the position of a paper sheet (e.g., the position of a label) and keep positions on labels where print information is printed constant, without being influenced by, e.g., the paper type, paper dust, an optical sensor (the light emission amount of a photointerrupter), and the like.

As has been described above, the present invention can provide a printer capable of accurately detecting print positions of a printing medium and keeping positions where a printer prints data constant.

As many apparently widely different embodiments of the present invention can be made without departing from the spirit and scope thereof, it is to be understood that the invention is not limited to the specific embodiments thereof except as defined in the appended claims.

Claim of Priority

This application claims priority from Japanese Patent Application No. 2003-202538 filed on Jul. 28, 2003, which is hereby incorporated by reference herein.

What is claimed is:

1. A printer which conveys in a convey direction a continuous printing medium having print positions specified at predetermined intervals and performs printing, comprising:

storage means for storing first information related to the print position of the printing medium;

detection means arranged on a convey path for detecting position information on the conveyed printing medium and outputting a value;

generating means for comparing the output value from said detection means with a threshold value and generating second information corresponding to the first information; and threshold value change means for changing the threshold value such that the second information coincides with the first information, wherein the printing medium is a label paper sheet comprised of a continuous layout sheet and labels affixed to the layout sheet at predetermined intervals, and the print position information includes one of a label size and a label gap, wherein said threshold value change means uses as a reference threshold value an average value of output values of label size portions and output values of gap portions between the label portions detected by said detection means in a print operation, compares an output value from said detection means with the reference threshold value in the print operation to detect one of the label size and the label gap, determines a correction amount for the reference threshold value such that the one of the detected label size and the detected label gap coincides with one of a set label size and a set label gap, and changes the threshold value using the correction amount and the reference threshold value, wherein said threshold value change means has a correction amount acquisition table with which a threshold value correction amount for correcting the reference threshold value can be calculated from a difference between the detected print position information and the set print position information and changes the threshold value using the correction amount acquisition table.

2. The printer according to claim 1, wherein if the detected print position information is different from the set print position information by not less than a predetermined value, said threshold value change means determines that an error has occurred and does not determine the threshold value.

3. The printer according to claim 1, wherein said threshold value change means holds initial values of different types of threshold values so as to support different types of printing media, and if said threshold value change means determines that printing medium print position information set by said setting means is different from printing medium print position information used in a previous print operation, said threshold value change means selects and uses an appropriate one of the held initial values of the threshold values.

4. The printer according to claim 1, wherein said storage means stores a plurality of first information corresponding to kinds of the printing medium, and the printer further comprising selecting means for selecting one of the plurality of first information stored in the storage means.

* * * * *

UNITED STATES PATENT AND TRADEMARK OFFICE

CERTIFICATE OF CORRECTION

PATENT NO. : 7,025,517 B2
APPLICATION NO. : 10/893933
DATED : April 11, 2006
INVENTOR(S) : Moriyoshi Inaba It is certified that error appears in the above-identified patent and that said Letters Patent is hereby corrected as shown below:

IN THE DRAWINGS:
Sheet No. 8, Figure 6, Item S607, "PAPE" should read --PAPER--.
Sheet No. 12, Figure 9, Item S906, "PAPE" should read --PAPER--.

COLUMN 11:
Line 62, "portion" should read --the portion--.

Signed and Sealed this

Twenty-fourth Day of July, 2007

JON W. DUDAS
*Director of the United States Patent and Trademark Office*